US008104657B2

(12) United States Patent
Barella

(10) Patent No.: US 8,104,657 B2
(45) Date of Patent: Jan. 31, 2012

(54) METHODS AND APPARATUS FOR STORING AND DISPENSING FLEXIBLE SHEET MATERIALS

(75) Inventor: Daniel J. Barella, Fort Collins, CO (US)

(73) Assignee: Lazy Daniel, LLC, Fort Collins, CO (US)

( * ) Notice: Subject to any disclaimer, the term of this patent is extended or adjusted under 35 U.S.C. 154(b) by 978 days.

(21) Appl. No.: 11/677,494

(22) Filed: Feb. 21, 2007

(65) Prior Publication Data

US 2007/0194036 A1 Aug. 23, 2007

Related U.S. Application Data

(60) Provisional application No. 60/775,568, filed on Feb. 21, 2006.

(51) Int. Cl.
*A47K 10/24* (2006.01)
*B65F 1/00* (2006.01)

(52) U.S. Cl. ..... 225/39; 225/6; 221/26; 220/495.07

(58) Field of Classification Search ..... 225/6, 7, 225/9, 27, 28, 32, 39, 49, 53, 91; 221/41, 221/47, 26, 63, 33, 45, 46; 220/495.07, 495.01, 220/908; 206/390, 554, 494
See application file for complete search history.

(56) References Cited

U.S. PATENT DOCUMENTS 2,004,614 A * 6/1935 Meagher ..... 206/63.5
3,098,594 A 7/1963 Williamson
3,229,876 A 1/1966 Osborn, Jr.
3,868,052 A * 2/1975 Rockefeller ..... 225/106
4,179,055 A 12/1979 Milner
4,674,634 A 6/1987 Wilson
4,714,191 A 12/1987 Richardson
4,793,539 A 12/1988 Haenni et al.
4,850,486 A 7/1989 Neibaur
4,930,385 A 6/1990 Wilfong, Jr. et al.
4,955,505 A 9/1990 Battaglia
5,135,134 A * 8/1992 Dancy ..... 221/61
5,170,957 A 12/1992 Carpenter
5,183,157 A 2/1993 Darden
5,207,368 A 5/1993 Wilfong, Jr. et al.
5,325,992 A 7/1994 Koller et al.
5,353,950 A 10/1994 Taylor et al.
5,542,568 A * 8/1996 Julius ..... 221/63
5,573,168 A 11/1996 Kannankeril et al.

(Continued)

OTHER PUBLICATIONS

U.S. Appl. No. 60/775,568, filed Feb. 21, 2006, 27 pages.

*Primary Examiner* — Phong Nguyen
(74) *Attorney, Agent, or Firm* — Santangelo Law Offices, P.C.

(57) ABSTRACT

Methods and apparatus may permit the storage of flexible sheet materials in a space-efficient manner and may provide a continuous point-of-use dispensing capability of such sheet materials at such stored location. Serially joined sheet materials may be separated from one another at sheet materials separation zones utilizing interference tabs having yieldable configurations, intra-planar configurations, trans-axial configurations, movement resistive configurations, and projective configurations. Such interference tab configurations may permit the simplified design and construction of a sheet materials dispensation apparatus, and multiple flexible sheet materials may be serially joined for use with such configurations. A substantially rigid enclosure for storing such serially joined sheet materials and incorporating an interference tab having one or more of such configurations may be dimensioned to dispense sheet materials from within an open-ended receptacle, for example a refuse container.

42 Claims, 7 Drawing Sheets

U.S. PATENT DOCUMENTS

| | | | | |
|---|---|---|---|---|
| 5,671,847 | A | 9/1997 | Pedersen et al. | |
| 5,738,239 | A | 4/1998 | Triglia | |
| 6,126,031 | A | 10/2000 | Reason | |
| 6,182,858 | B1 * | 2/2001 | Hartog | 221/63 |
| 6,193,095 | B1 | 2/2001 | McNeil | |
| 6,283,405 | B1 | 9/2001 | Tracy | |
| D474,056 | S | 5/2003 | Mandell | |
| 6,578,730 | B2 | 6/2003 | Trunsky | |
| D482,915 | S | 12/2003 | Yang et al. | |
| 6,766,919 | B2 * | 7/2004 | Huang et al. | 221/63 |
| 6,834,773 | B2 | 12/2004 | Wu | |
| 2003/0136793 | A1 | 7/2003 | Chen | |
| 2005/0082294 | A1 * | 4/2005 | Ceschi | 220/495.07 |
| 2005/0092753 | A1 * | 5/2005 | Best | 220/495.07 |

* cited by examiner

METHODS AND APPARATUS FOR STORING AND DISPENSING FLEXIBLE SHEET MATERIALS

This application claims the benefit of U.S. Provisional Application No. 60/775,568, filed Feb. 21, 2006, hereby incorporated herein by reference.

BACKGROUND OF THE INVENTION

Generally, the inventive technology described herein relates to storing and dispensing flexible sheet materials. More specifically, the inventive technology involves storing such flexible sheet materials in a space-efficient manner and providing a continuous point-of-use dispensing capability at such stored location. The inventive technology may be particularly suited for providing trash bags in refuse containers.

Many objects in contemporary society take their usefulness from being configured in the form of a flexible sheet. Common examples may include paper, tissues, paper towels, cellophane wrap, tin foil, and the like. From these examples it may be seen that the usefulness of these objects derives at least in part from their flexible sheet configuration, which may confer advantages in storing, dispensing, and utilizing these products.

One frequently seen example of objects taking the form of flexible sheets may be flexible bags. Flexible bags may be common items with a variety of uses in contemporary society. For example, flexible bags may be used in supermarkets to bag groceries, as sandwich bags for domestic use, or perhaps as trash bags for use in refuse containers. The nature of these examples may illustrate the potential desirability of storing such flexible bags at a central location to which is provided convenient access and the ability to retrieve individual bags on an as-needed basis. In particular, the ability to store flexible bags in a space-efficient manner may be desirable so as to maximize the number of such bags on hand for a given volume of storage space. Moreover, providing the ability to continuously dispense bags at their point of use may minimize problems associated with storing such bags at one location and using them at another location.

With particular attention to trash bags used in refuse containers, for example, it may be appreciated that trash bags generally may be flexible bags lining a more rigid refuse container. The trash bag may act to contain refuse placed in the refuse container. When the trash bag is filled to capacity, it may typically be lifted out of the more rigid refuse container and disposed of in an appropriate manner. A subsequent trash bag may then be obtained and placed within the refuse container, acting as a fresh liner capable of holding further refuse.

This process may entail several inefficiencies capable of being rectified. For example, obtaining a subsequent trash bag may involve accessing a storage location for trash bags that is remote from the refuse container, resulting in time and effort to retrieve the trash bag and transport it to the refuse container. Fitting the trash bag into the container also may require a degree of time and effort, for example perhaps by requiring one to bend or reach to position the trash bag within the refuse container and perhaps by requiring the use of one's hands to stretch or shape the trash bag for placement in a configuration to line the refuse container.

Moreover, conventional technologies for storing and dispensing trash bags also may entail drawbacks. For example, serially joining trash bags into a configuration such as a stack or roll may make them convenient to store at a remote location. However, storing such a stack or roll at the location where individual trash bags are to be used—for example, within a refuse container itself—can be difficult, in as much as conventional refuse containers generally may be designed only to hold one trash bag at a time. Moreover, storing such a stack or roll of serially joined trash bags in a refuse container may create difficulties in separating the trash bag to be used from the next bag in the stack or roll. In this situation, conventional technologies for separating trash bags may entail a number of disadvantages, such as perhaps requiring the use of a potentially sharp cutting surface, requiring hand assisted separation of trash bags within the confines of the refuse container, the incomplete or inefficient separation of one trash bag from another, or perhaps requiring a filled trash bag to be removed in its entirety from the refuse container while joined to the next trash bag in sequence, perhaps necessitating their separation in midair.

Of course, it may be appreciated that these issues may arise in the analogous storage and dispensation of a great variety of flexible sheet materials, not limited only to trash bags as exemplified above. The foregoing problems regarding the inefficiencies associated with storing and dispensing flexible sheet materials may represent a long-felt need for an effective solution to the same. While implementing elements may have been available, actual attempts to meet this need may have been lacking to some degree. This may have been due to a failure of those having ordinary skill in the art to fully appreciate or understand the nature of the problems and challenges involved. As a result of this lack of understanding, attempts to meet these long-felt needs may have failed to effectively solve one or more of the problems or challenges here identified. These attempts may even have led away from the technical directions taken by the present inventive technology and may even result in the achievements of the present inventive technology being considered to some degree an unexpected result of the approach taken by some in the field.

SUMMARY OF THE INVENTION

The inventive technology relates to methods and apparatus for storing and dispensing flexible sheet materials and may include one or more of the following features: techniques for storing flexible sheet materials in a space-efficient manner; techniques for providing a continuous point-of-use dispensing capability for flexible sheet materials; techniques for efficient separation of serially joined flexible sheet materials; techniques for separation of serially joined flexible sheet materials utilizing yieldable configurations; techniques for separation of serially joined flexible sheet materials utilizing planar configurations; techniques for separation of serially joined flexible sheet materials utilizing trans-axial configurations; techniques for separation of serially joined flexible sheet materials utilizing movement resistive configurations; techniques for separation of serially joined flexible sheet materials utilizing projective configurations; techniques for simplified design and manufacture of sheet materials separation apparatus; techniques for serially joining multiple flexible sheet materials; and techniques for dimensioning a rigid enclosure in which multiple flexible sheet materials may be stored to the dimensions of a receptacle. Accordingly, the objects of the methods and apparatus for storing and dispensing flexible sheet materials described herein address each of the foregoing problems in a practical manner. Naturally, further objects of the inventive technology will become apparent from the description and drawings below.

DETAILED DESCRIPTION OF THE PREFERRED EMBODIMENTS

Figure 1:
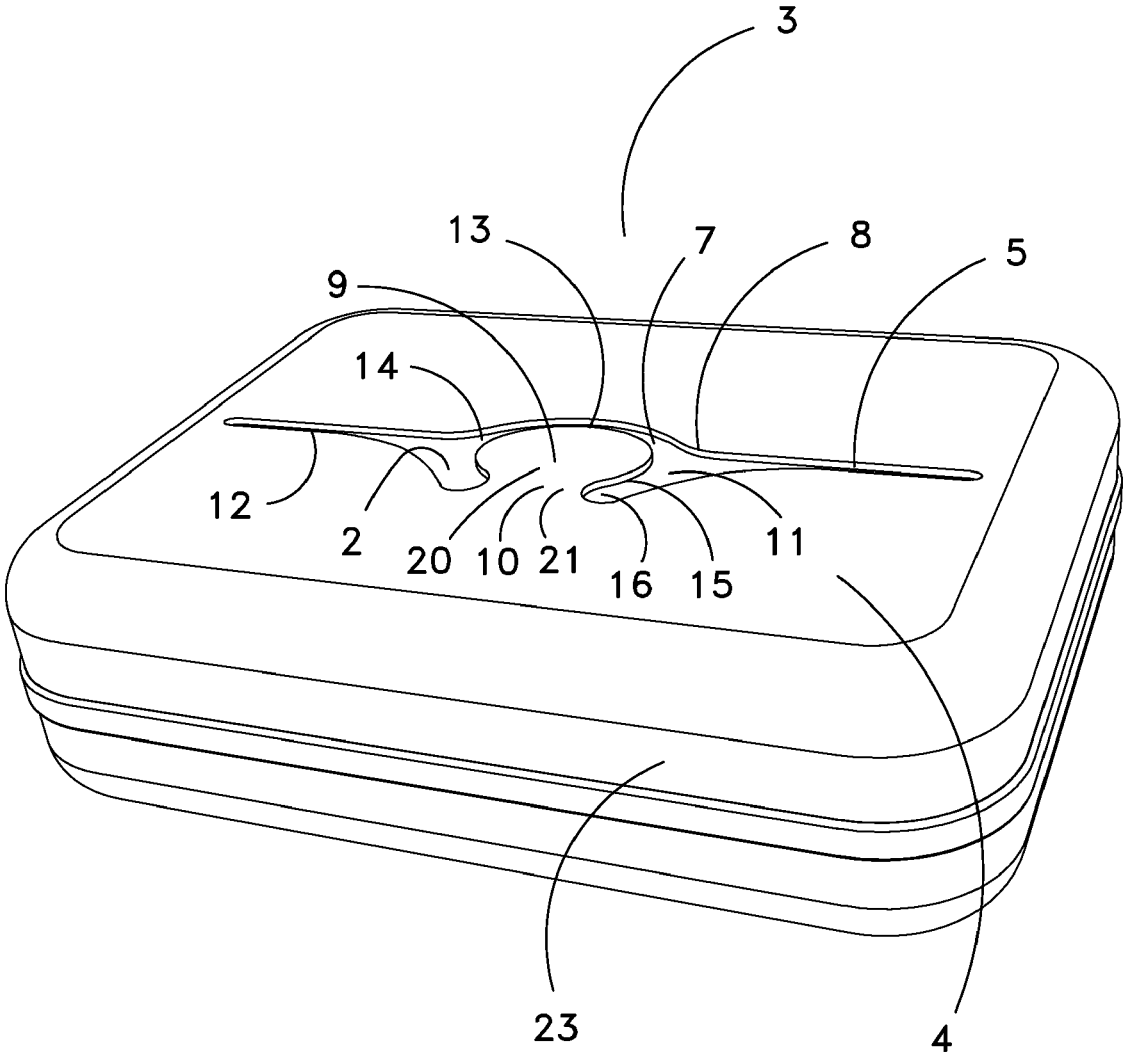
FIG. 1 is a perspective view of a substantially rigid enclosure in one embodiment.

As mentioned earlier, the present inventive technology includes a variety of aspects, which may be combined in different ways. The following descriptions are provided to list elements and describe some of the embodiments of the present inventive technology. These elements are listed with initial embodiments, however it should be understood that they may be combined in any manner and in any number to create additional embodiments. The variously described examples and preferred embodiments should not be construed to limit the present inventive technology to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Now referring primarily to FIGS. 1-6, various embodiments may involve the use of sheet materials (1). Sheet materials (1) may include any objects having the configuration of a substantially sheet-like manner. Examples of sheet materials may include paper, tissues, paper towels, cellophane wrap, tin foil, and the like, however these should be understood as illustrative only and should not be construed to limit the number or kinds of objects that may be considered a sheet material. In addition, the term substantially sheet-like should be understood to encompass a sheet. Embodiments further may involve a sheet materials storage area (2) and a sheet materials utilization area (3). A sheet materials storage area (2) may encompass simply an area in which one or more sheet materials (1) may be stored when not in use. Similarly, a sheet materials utilization area (3) may be simply an area that is not a sheet materials storage area (2), for example as when a sheet material (1) drawn from the sheet materials storage area (2) consequently may be considered to be in use. Moreover, sheet materials (1) stored in a sheet materials storage area (2) of course may be stored in any configuration suitable to the storage area, including for example in a rolled, stacked, or folded configuration. Accordingly, embodiments may involve storing a sheet material (1) within a sheet materials storage area (2).

In some embodiments, a sheet materials dispensation path may lie between a sheet materials storage area (2) and a sheet materials utilization area (3). Such a sheet materials dispensation path simply may be the path through which sheet materials (1) drawn from a sheet materials storage area (2) to a sheet materials utilization area (3) may travel. Naturally, such a path may be seen to be in communication with the sheet materials storage area (2) and the sheet materials utilization area (3). Moreover, such a path may take any suitable configuration to permit sheet materials to be drawn from the sheet materials storage area (2) to the sheet materials utilization area (3), subject to interference from an interference tab (9), perhaps as discussed elsewhere herein. For example, various embodiments may include a direct path, a guided path, a path having at least one degree of freedom of movement in a direction exclusive of the drawn direction, and the like. Accordingly, embodiments may include drawing at least a portion of a sheet material (1) from a sheet materials storage area (2) to a sheet materials utilization area (3) along a sheet materials dispensation path.

Embodiments may further include a substantially rigid planar sheet materials containment surface (4) separating said sheet materials storage area (2) and said sheet materials utilization area (3). Such a surface may involve simply containing sheet materials (1) stored in a sheet materials storage area (2), or, stated differently, may involve simply segregating stored sheet materials (1) from a sheet materials utilization area (3). Moreover, the term substantially rigid should be understood to include rigid. Accordingly, embodiments may include storing a sheet material (1) on a first side of a substantially rigid planar sheet materials containment surface (4).

A substantially rigid planar sheet materials containment surface (4) in some embodiments may include an intra-planar sheet materials override edge. Such an edge simply may provide a surface within the plane of the substantially rigid planar sheet materials containment surface (4) upon which a sheet material drawn from a sheet materials storage area (2) may override. Embodiments further may involve a non-linearly opposed sheet materials opening established contiguous to and in opposition to an intra-planar sheet materials override edge. Such an opening perhaps may include a space of any suitable configuration disposed through a substantially rigid planar sheet materials containment surface (4) to create an opening having proportions larger than a slot-like configuration. In some embodiments, an intra-planar interference tab (9), perhaps as described elsewhere herein, may be joined to such a sheet materials override edge extended into the non-linearly opposed sheet materials opening. Accordingly, embodiments may include drawing at least a portion of said sheet material through a non-linearly opposed sheet materials opening, contacting the portion to an intra-planar sheet materials override edge, and engaging the sheet material to an intra-planar interference tab.

Moreover, embodiments may include a sheet materials dispensation slot (5) disposed through said substantially rigid planar sheet materials containment surface (4) and established in communication with said sheet materials storage area (2) and said sheet materials utilization area (3). Such a sheet materials dispensation slot (5) may have any suitable elongated configuration consistent with its sheet materials dispensation function as described herein. Additionally, a sheet materials dispensation slot (5) may have a lengthwise axis (6). Such a lengthwise axis (6) in some embodiments may be visualized as a line aligned along the lengthwise orientation of a sheet materials dispensation slot (5), and in some embodiments may coincide with the plane of travel through which a sheet material (1) may move when drawn through the sheet materials dispensation slot (5). Moreover, while embodiments certainly may include a sheet materials dispensation slot (5) and a lengthwise axis (6) disposed in a linear configuration, alternate configurations of course may be possible, including perhaps curved configurations or segmented configurations. Accordingly, embodiments may include drawing at least a portion of a sheet material (1) through a sheet materials dispensation slot (5).

A sheet materials dispensation slot (5) in certain embodiments may be a unidirectional slot. A unidirectional slot may be a slot promoting or perhaps even permitting the travel of sheet materials (1) through the slot in only one direction. For example, a unidirectional slot in some embodiments may involve a one-way flap (27) disposed along one edge of a sheet materials dispensation slot (5), perhaps wherein the one-way flap (27) is configured to yield in one direction and resist a yield in the opposing direction. Accordingly, embodiments may include unidirectionally drawing a sheet material (1) through a sheet materials dispensation slot (5), perhaps involving depressing a one-way flap (27).

Embodiments also may include configuring a sheet materials dispensation slot (5) as a sheet orientation confinement slot. A sheet orientation confinement slot may act to confine a sheet material (1) into a desired orientation through interaction of the sheet material (1) with the dimensions of the slot. For example, a slot dimensioned into a substantially linear configuration may promote a sheet-like configuration of a sheet material drawn through the slot, in as much as the linear dimensions of the slot may tend to resist deformation of the sheet material out of its sheet-like orientation. Further, the term substantially linear should be understood to encompass linear. Accordingly, embodiments may include confining a portion of a sheet material (1) to a sheet-like orientation through the dimensions of a sheet materials dispensation slot (5).

Various embodiments may include a terminal portion recess (7) disposed along a first edge (8) of a sheet materials dispensation slot (5). Such a terminal portion recess (7) may involve providing a space in which the terminal portion (13) of an interference tab (9) may be accommodated. Moreover, it may be seen that such a terminal portion recess (7) may be displaced from the lengthwise axis (6) of a sheet materials dispensation slot (5), perhaps as a consequence of the trans-axial nature of the yieldable intra-planar trans-axial interference tab (9), and accordingly may be considered to be contiguous to but recessed from the elongate dimension of the sheet materials dispensation slot (5).

Of course, it will be appreciated that terminal portion recess (7) may take any suitable configuration consistent with the discussion herein. For example, in various embodiments the shape of a terminal portion recess (7) may be curved, polygonal, pointed, and the like. Embodiments even may include a matched terminal portion recess (7), wherein the shape of the terminal portion recess (7) may be matched to the shape of a terminal portion (13) of an interference tab (9) disposed within the terminal portion recess (7). Accordingly, embodiments may include matching a configuration of a terminal portion recess (7) to the configuration of a terminal portion (13) of an interference tab (9).

Moreover, embodiments may include functionally configuring a terminal portion recess (7) to implement an action on a sheet material (1) drawn through a sheet materials dispensation slot (5). For example, in some embodiments a terminal portion recess (7) may be a sheet material deformation confinement recess, wherein a sheet material (1) drawn through a sheet materials dispensation slot (5) may be confined within the terminal portion recess (7) due to the dimensions of its configuration, and accordingly may be deformed from its sheet-like configuration into the configuration of the terminal portion recess (7) as it passes through the sheet materials dispensation slot (5). Such confinement of course may be implemented by configuring the terminal portion recess (7) into any appropriate configuration. For example, embodiments may include establishing a space (14) between the terminal portion recess (7) and the terminal portion (13) of a trans-axial interference tab (9) disposed within the recess, such that a sheet material (1) passing through a sheet materials dispensation slot (5) must pass through the space (14) within the terminal portion recess (7) and accordingly be deformed. Accordingly, embodiments may include deforming a sheet material (1) by confining the sheet material (1) within a terminal portion recess (7).

Embodiments also may include a base portion recess (11) disposed along a second edge (12) of a sheet materials dispensation slot (5). Such a base portion recess (11) may involve providing a space in which the base portion (10) of an interference tab (9) may be accommodated. Moreover, it may be seen that such a base portion recess (11) may be displaced from the lengthwise axis (6) of a sheet materials dispensation slot (5), and accordingly may be considered to be contiguous to but recessed from the elongate dimension of the sheet materials dispensation slot (5).

A base portion recess (11) in some embodiments may include a sheet materials wraparound zone (15). When an interference tab (9) interferes with the travel of a sheet material (1), such a sheet materials wraparound zone (15) may permit the sheet material (1) to wrap around the sides of the interference tab (9). Such wrapping of the sheet material (1) about the interference tab (9) within a base portion recess (11) may increase the effectiveness with which the interference tab (9) is able to engage the sheet material (1). For example, such wrapping may increase the effectiveness with which a sheet materials resistance projection (17) may operate by providing increased leverage of the interference tab (9) against the sheet material (1). In some embodiments, the angle through which a sheet material (1) may wrap around an interference tab (9) may be increased by providing a cutaway (16) on each side of the base portion (10) of the interference tab (9). Such a cutaway (16) may provide additional space in which a sheet material (1) may engage an interference tab (9).

Various embodiments may include an interference tab (9). An interference tab (9) may include any tab-like element disposed relative to a sheet materials dispensation slot (5) suitable to interfere with the travel of a sheet material (1) through the slot. In some embodiments, interfering with an interference tab (9) may involve physically impeding such travel of a sheet material (1), perhaps to include diverting the path of at least a portion of such a sheet material (1) to move the sheet material (1) around the interference tab. For example, in various embodiments interfering may include frictionally resisting a movement of a sheet material (1) or displacing a motion of a sheet material (1). Embodiments may include deforming a sheet orientation of a sheet material (1), for example as perhaps where a substantial portion of the sheet material (1) may retain its sheet-like orientation, with exception for a portion of the sheet material (1) becoming deformed through contact with the interference tab (9). In some embodiments, interfering may even include tearing a sheet material (1), or perhaps even separating at least two serially joined sheet materials (1) at a sheet materials separation zone (19).

Additionally, interfering in various embodiments may include supporting at least a portion of a sheet material (1) on the interference tab (9), for example as where the interference tab may have a flat surface area sufficient to support a corresponding flat area of a sheet material (1) drawn over the tab. Such embodiments may be particularly useful to facilitate the resistive action of a resistance projection (17) disposed on an interference tab (9), as described elsewhere herein.

In some embodiments, an interference tab (9) may be a trans-axial interference tab (9). The term trans-axial may be understood to include orientations of an interference tab (9) involving at least some contiguous portion of the interference tab (9) as being located on each side of a lengthwise axis (6) of a sheet material dispensation slot (5), such that the interference tab (9) extends across the lengthwise axis (6) of the sheet materials dispensation slot (5). Of course, such trans-axial orientations may take any of a variety of suitable configurations consistent with the discussion herein. For example, a trans-axial interference tab (9) may be centered relative to a lengthwise axis (6), shifted off-center relative to a lengthwise axis (6), perpendicular to a lengthwise axis (6), intersect a lengthwise axis (6), and the like.

Embodiments also may include an intra-planar interference tab (9). By the term intra-planar, it may be understood that an interference tab (9) may be configured to lie substantially within the same plane as a substantially rigid planar sheet materials containment surface (4). For example, embodiments may involve perhaps simply cutting out an interference tab (9) from a substantially planar surface, or possibly simply cutting out a sheet materials dispensation slot (5) from a substantially planar surface, thereby creating an intra-planar interference tab (9). In this manner, a sheet materials dispensation slot (5) or an intra-planar interference tab (9) may be seen to be a cutout. Moreover, it may be seen that establishing an interference tab (9) or a sheet materials dispensation slot (5) by cutting out from a substantially planar surface may simplify the design and manufacture of such tabs and slots. Of course, the term substantially planar should be understood to include planar.

An interference tab (9) in various embodiments also may be a yieldable interference tab (9). A yieldable interference tab (9) may involve an interference tab (9) having at least some degree of flex, for example perhaps as where the interference tab (9) may flex in response to contact from the travel of a sheet material (1). In some embodiments, a yieldable interference tab (9) may flex at a yield zone (22), perhaps wherein the yield zone (22) coincides with some or all of a narrow sub-terminal dimension (21) of an interference tab (9), as described elsewhere herein.

Moreover, a yieldable interference tab (9) in various embodiments may have a yield profile. A yield profile may include one or more attributes of the yield of a yieldable interference tab (9) by which the yield may be characterized. Examples of a yield profile of a yieldable interference tab (9) in various embodiments may include a substantially curved yield profile, a substantially pivoted yield profile, a yield profile having an angular displacement from 0 degrees to 90 degrees, and the like. By the terms curved and pivoted, it may be understood that the shape of the yield profile may approximate a curve or a pivot, respectively. It also may be noted that the configuration selected for a yieldable interference tab (9) may dictate the yield profile possessed by the tab. For example, in various embodiments a narrow sub-terminal dimension (21) may be established to create yield profiles ranging from substantially pivoted to substantially curved. Accordingly, embodiments may include yielding a yieldable interference tab (9) at a narrow sub-terminal dimension (21), including perhaps curving such a yield, pivoting such a yield, or perhaps angularly displacing such a yield through a range from 0 degrees to 90 degrees.

In various embodiments, a yieldable interference tab (9) may include a sheet material movement responsive yieldable interference tab (9) or a sheet material movement facilitative yieldable interference tab (9). Such yieldable interference tabs (9) respectively may respond to the movement of a sheet material (1) across the tab by yielding, and in yielding perhaps may facilitate movement of the sheet material (1) across the tab, possibly by decreasing the resistance of the tab. Similarly, some embodiments may include an increased resistance yieldable interference tab (9), which may entail progressively increasing yield resistance as the degree of yield is increased. In some embodiments, a yieldable interference tab (9) may be a resistance projection repositioned yieldable interference tab, which may be understood to involve repositioning a resistance projection (17) disposed on a yieldable interference tab (9) as a consequence of yielding the tab.

An interference tab (9) in various embodiments may have a base portion (10). A base portion (10) may include simply any portion of an interference tab (9) basally located on an interference tab's (9) tab-like configuration. In some embodiments, an interference tab (9) may be joined to a substantially rigid planar sheet materials containment surface (4) at such a base portion (10), perhaps within a base portion recess (11), or perhaps directly along a second edge (12) of a sheet materials dispensation slot (5).

In various embodiments, an interference tab (9) may have a terminal portion (13). A terminal portion (13) may include simply any portion of an interference tab (9) disposed toward the free end of the interference tab's (9) tab-like configuration. In the case of a trans-axial interference tab (9), it may be appreciated that the base portion (10) and the terminal portion (13) of an interference tab (9) will lie on opposite sides of a lengthwise axis (6). Moreover, in various embodiments an interference tab (9) may terminate at a terminal portion (13) within a terminal portion recess (7). Of course, it may be appreciated that a terminal portion (13) may take any suitable configuration consistent with the discussion herein. For example, embodiments may include a curved terminal portion (13), a polygonal terminal portion (13), a pointed terminal portion (13), and the like.

In the foregoing manner, it may be seen that an interference tab (9) in various embodiments may include any or all of the attributes of a yieldable intra-planar trans-axial interference tab (9). Moreover, an interference tab (9) may include a base portion (10), a terminal portion (13), and a shaft portion (20). A shaft portion (20) perhaps simply may include an intermediate area of an interference tab (9) disposed between a base portion (10) and a terminal portion (13).

Accordingly, embodiments may involve contacting a surface of a portion of a sheet material (1) to a terminal portion (13) of a yieldable intra-planar trans-axial interference tab (9) during the process of drawing the portion of the sheet material (1) through a sheet materials dispensation slot (5). For example, in some embodiments contacting may involve overriding the terminal portion (13) of the interference tab (9), and the tab may be considered to be a sheet materials override interference tab (9). Embodiments further may involve forcing the sheet material (1) into a terminal portion recess (7) via the process of contacting the surface of the portion of the sheet material (1) to the yieldable intra-planar trans-axial interference tab (9). For example, in some embodiments forcing may involve displacing the sheet material (1) from a lengthwise axis (6) of a sheet materials dispensation slot (5), and the interference tab (9) may be considered to be a sheet materials axial displacement interference tab (9). Embodiments still further may involve engaging the terminal portion (13) of the yieldable intra-planar trans-axial interference tab (9) to the portion of the sheet material (1).

Various embodiments may include narrowing a portion of an interference tab (9) to create a narrow sub-terminal dimension (21) of the interference tab (9). A narrow sub-terminal dimension (21) may involve dimensioning the width of an interference tab (9) at a location below the tab's terminal portion (13) to be narrower in dimension than a width dimension of the terminal portion (13). For example, embodiments may include a shaft portion (20) having a width dimension narrower than a width dimension of a terminal portion (13), or perhaps a base portion (10) having a width dimension narrower than a width dimension of a terminal portion (13). Similarly, embodiments may involve locating such a narrow sub-terminal dimension (21) on an interference tab (9) at a desired location relative to a lengthwise axis (6), for example perhaps extending across a lengthwise axis (6) or perhaps located on the opposite side of a lengthwise axis (6) relative to the location of a terminal portion (13). Accordingly, a narrow sub-terminal dimension (21) in some embodiments perhaps may be visualized as being configured in the form of a narrow neck on an interference tab (9).

Further, a narrow sub-terminal dimension (21) in some embodiments may be defined by providing a cutaway (16) established around each side of a base portion (10). In various embodiments, such a cutaway (16) may be contiguous to and perhaps form a part of or extension of a base portion recess (11). Additionally, a cutaway (16) in various embodiments perhaps may form part of a wraparound zone (15). Accordingly, various embodiments may involve establishing a narrow sub-terminal dimension (21) by cutting away at least some of a base portion (10), and perhaps even may include establishing a base portion recess (11) by cutting away at least some of a base portion (10).

A narrow sub-terminal dimension (21) in various embodiments also may be a yield zone (22) of an interference tab (9). A yield zone (22) may include a portion of a yieldable interference tab (9) at which the yieldable interference tab (9) has at least some degree of flex. Indeed, by creating a narrow neck configuration, a narrow sub-terminal dimension (21) constituting a yield zone (22) in various embodiments may impart some or all of the degree of flex characterizing the yieldable nature of a yieldable interference tab (9).

Figure 7:
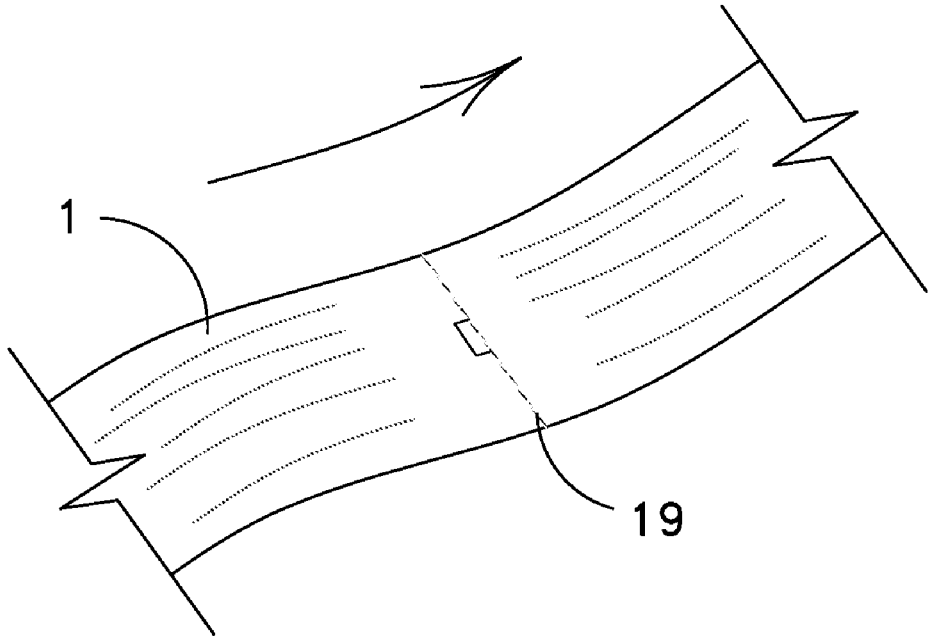
FIG. 7 is a conceptual view of a sheet materials separation zone disposed between two serially joined sheet materials in one embodiment.
Figure 8:
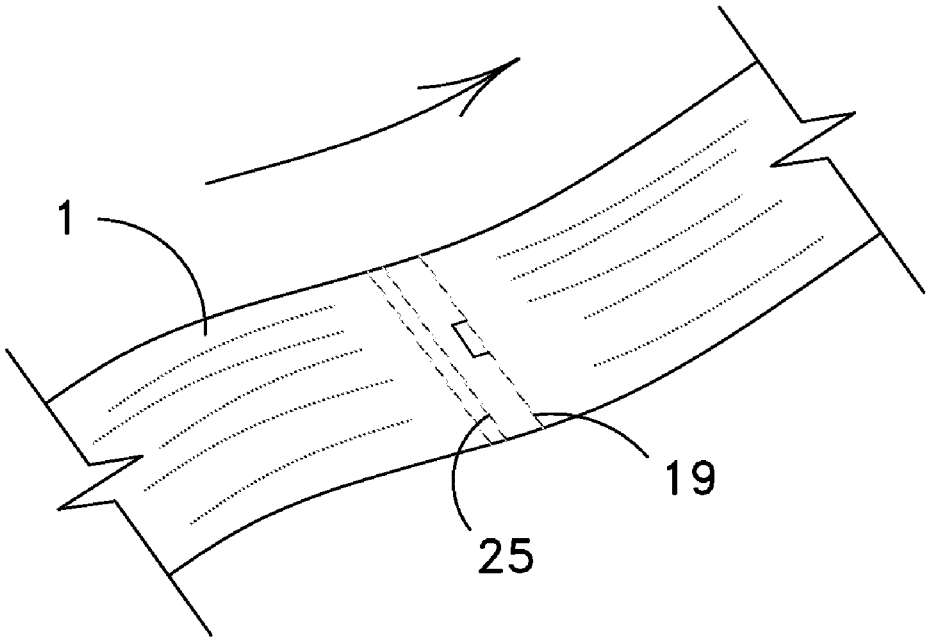
FIG. 8 is a conceptual view of a drawstring established on a serially joined sheet material in one embodiment.

Now referring primarily to FIGS. 7-8, various embodiments may include a sheet materials resistance projection (17) disposed on an interference tab (9). Such a sheet materials resistance projection (17) may be raised from an interference tab (9) in a configuration resistive to the movement of a sheet material (1) drawn across the interference tab (9). For example, in some embodiments a sheet materials resistance projection (17) simply may be a blunt surface, wherein it may be appreciated that orienting said blunt surface against the motion of a sheet material (1) may serve to resist the motion of the sheet material (1). Examples of a resistance projection (17) configured as a blunt surface may include a flat surface, a curved surface, the side of a cylindrical projection, the side of a polygonal projection, the surface of spherical projection, the surface of an ovoid projection, and the like. Of course, these examples are merely illustrative, and should not be construed to limit the configuration to which a blunt surface, or indeed a resistance projection (17), may take. By way of comparison, for example, a resistance projection (17) in certain embodiments may involve a sharp edge, perhaps to resist a movement of a sheet material (1) by tearing or piercing the sheet material (1). Accordingly, embodiments may involve resisting a movement of a portion of a sheet material (1) drawn along a sheet materials dispensation path with a resistance projection (17), including for example bluntly resisting and sharply resisting.

Moreover, a resistance projection (17) of course may have a degree of relief (18) relative to the interference tab (9) from which it is raised. Such a degree of relief (18) may be of any suitable rise to facilitate the resistive function of the resistance projection (17). For example, embodiments may involve coordinating the degree of relief (18) to a property of the sheet material (1) to be resisted. For example, where the resistance projection (17) is intended to deform the sheet material (1) or perhaps even pierce the sheet material (1), the level of rise may be established to compensate for sheet materials (1) of greater or lesser durability. Similarly, embodiments may include raising a resistance projection (17) a degree of relief (18) greater than about a thickness of the sheet material (1) or perhaps greater than a thickness of the interference tab (9). Of course, these examples are merely illustrative, and should not be construed to limit the levels of rise to which a degree of relief (18) may be established. Accordingly, embodiments may involve raising a resistance projection (17) relative to an interference tab (9) as herein discussed.

In various embodiments, a resistance projection (17) may be configured to engage a complementary attribute of a sheet material (1). Such a complementary attribute may include any attribute of the sheet material (1) configured as a counterpart to a resistance projection (17) that facilitates engagement. For example, in various embodiments a complementary attribute may include features of a sheet material (1) designed to physically catch on a resistance projection (17) such as slots, grooves, channels, openings, or the like established on the surface of the sheet material. Moreover, such complementary attributes of course may include an entire surface of a sheet material (1), or perhaps may include only a part or parts of a sheet material (1). In the latter case, it may be appreciated that a resistance projection (17) in fact may engage the sheet material (1) only at the site of the complementary attribute, and indeed perhaps may be drawn along other portions of the surface of the sheet material (1) without engaging the sheet material (1) at all. Accordingly, embodiments may involve engaging a resistance projection (17) to a complementary attribute of a sheet material (1), including perhaps only to such a complementary attribute. Moreover, in certain embodiments, a complementary attribute may involve a sheet materials separation zone (19), perhaps as discussed elsewhere herein.

Figure 5:
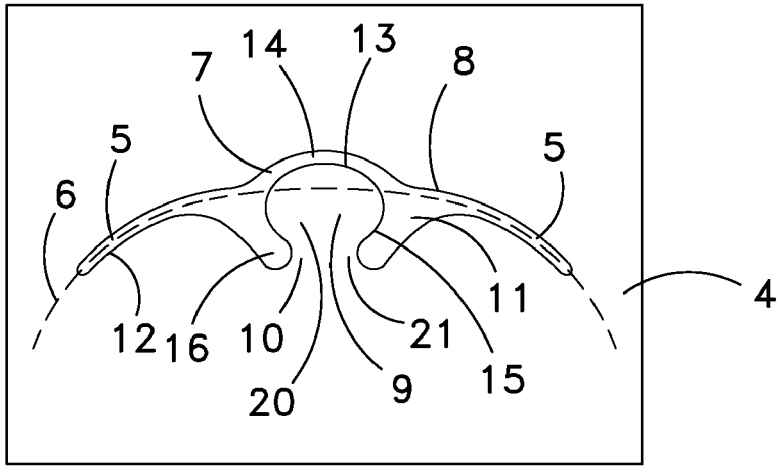
FIG. 5 is a top view of a curved sheet materials dispensation slot having a lengthwise axis in one embodiment.
Figure 6:
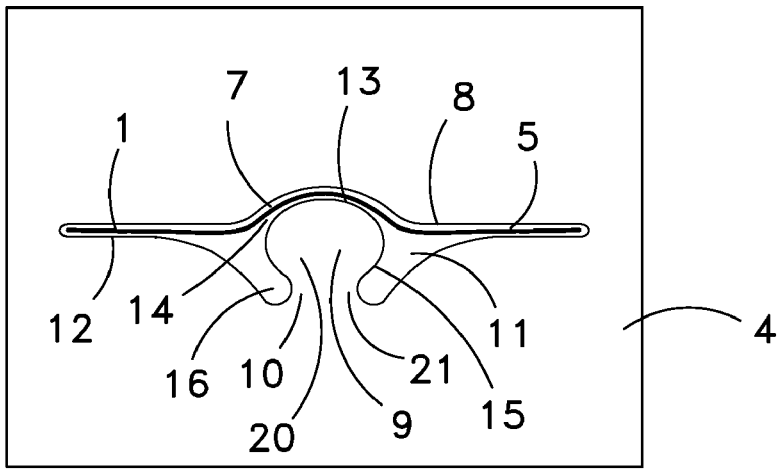
FIG. 6 is a top view of a sheet material deformed within a terminal portion recess in one embodiment.

Now referring primarily to FIGS. 5-6, various embodiments may involve serially joining multiple sheet materials (1) at sheet materials separation zones (19), and perhaps also separating at least two serially joined sheet materials (1) at a sheet materials separation zone (19). Sheet materials (1) that are serially joined may include perhaps simply joining two or more sheet materials (1) in sequence, for example, to permit multiple sheet materials (1) to be sequentially dispensed one at a time. A sheet materials separation zone (19) may be an area between two serially joined sheet materials (1) at which separation of the sheet materials (1) may be more readily accomplished. For example, a sheet materials separation zone (19) in various embodiments may include perforations, a gap, or perhaps even an in-line gap centered within a line of perforations. The term gap may be understood to include a space established between two serially joined sheet materials (1) in any suitable configuration to promote separation of the two sheet materials (1) from one another. Moreover, the foregoing examples of course should be understood to be merely illustrative of the manner in which a sheet materials separation zone (19) may be established between two or more serially joined sheet materials (1), and should not be construed to limit the manner in which a sheet materials separation zone (19) may be established.

With further reference to FIGS. 7-8, embodiments of course may include configuring a resistance projection (17) to separate at least two serially joined sheet materials (1) at a sheet materials separation zone (19). For example, a resistance projection (17) may be disposed on an interference tab (9) to engage a sheet materials separation zone (19) of a sheet material (1) as the sheet material (1) is drawn over the interference tab (9). In this manner, sheet materials (1) may be separated as a result of such engagement, for example perhaps by inducing a tear at the sheet materials separation zone (19). Moreover, in some embodiments, an interference tab (9) may provide a substantially planar surface to flatly support a sheet material (1) drawn over the interference tab (9), while a resistance projection (17) raised from the interference tab (9) may constitute a portion serving to engage a sheet materials separation zone (19) as the zone passes over the tab. Of course, this discussion highlights merely some possible configurations for a resistance projection (17), and should not be construed to limit the configurations to which a resistance projection (17) may take consistent with the principles discussed herein.

Moreover, the location of a resistance projection (17) on an interference tab (9) of course may be coordinated to the location of a sheet materials separation zone (19), so that when a sheet material (1) is drawn over the interference tab (9), the resistance projection (17) is optimally located to engage the sheet materials separation zone (19). For example, embodiments may include perhaps simply aligning the location of the resistance projection (17) to the location of sheet materials separation zones (19) of sheet materials (1) having a predefined travel path drawn over an interference tab (9). Similarly, embodiments may include optimizing the location of a resistance projection (17) on an interference tab (9) to optimally engage a sheet materials separation zone (19), for example perhaps by locating the resistance projection (17) on the interference tab (9) displaced from a lengthwise axis (6) of a sheet materials dispensation slot (5) and on an opposing side of the lengthwise axis (6) relative to a base portion (10) of the interference tab (9).

Figure 2:
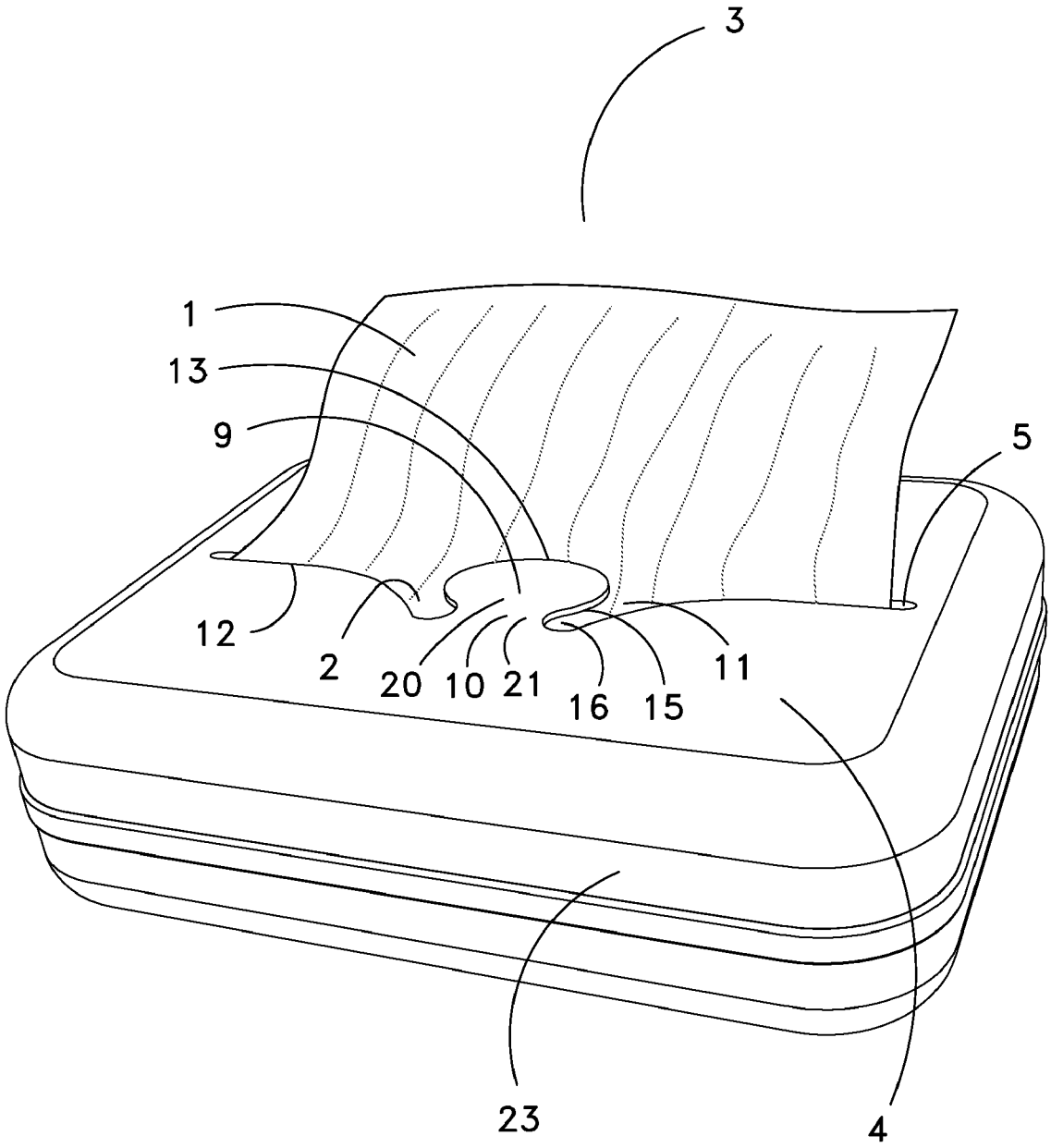
FIG. 2 is a perspective view of a substantially rigid enclosure having a sheet material disposed through a sheet materials dispensation slot in one embodiment.
Figure 3:
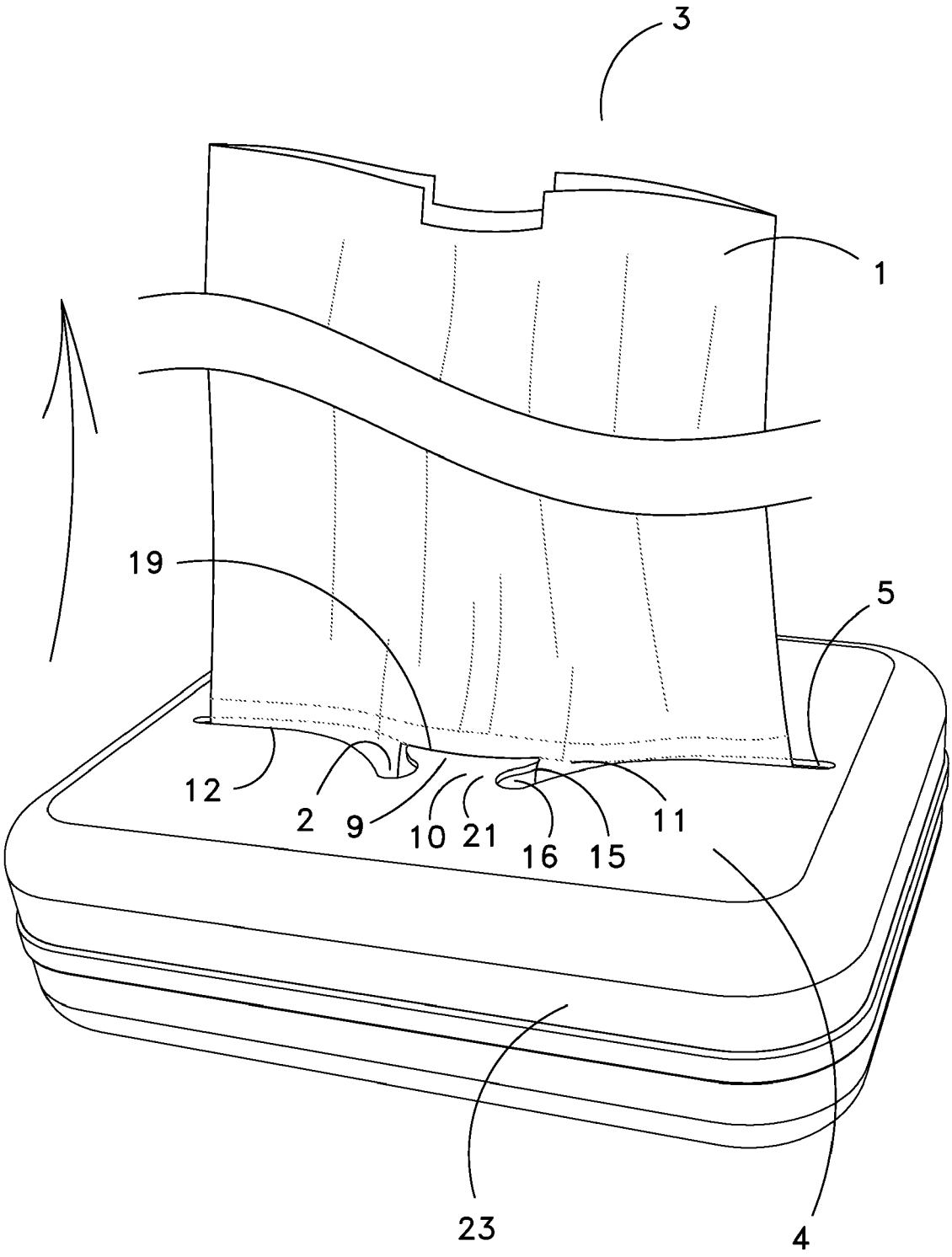
FIG. 3 is a perspective view of a substantially rigid enclosure having a sheet material separated at a sheet materials separation zone in one embodiment.
Figure 4:
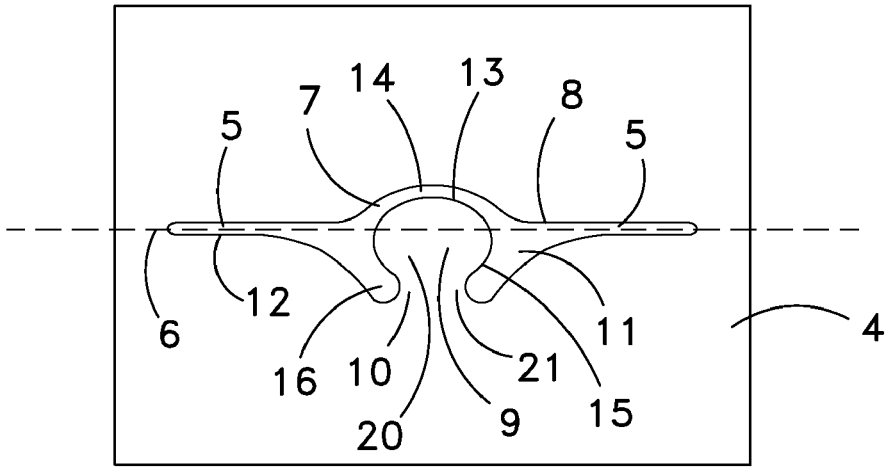
FIG. 4 is a top view of a straight sheet materials dispensation slot having a lengthwise axis in one embodiment.

With further reference primarily to FIGS. 1-3, in various embodiments, a substantially rigid planar sheet materials containment surface (4) may be formed as a constituent part of a substantially rigid enclosure (23). Such a substantially rigid enclosure (23) further may be configured to wholly or partly enclose a sheet materials storage area (2). For example, embodiments may involve forming the substantially rigid planar sheet materials containment surface (4) as one face of a substantially rigid casing that otherwise encloses a sheet materials storage area (2). Of course, embodiments further may include a sheet materials dispensation slot (5) disposed through the substantially rigid planar sheet materials containment surface (4) and established in communication with said a materials storage area (2) and a sheet materials utilization area (3). Moreover, embodiments may include storing multiple sheet materials (1) serially joined by sheet material separation zones (19) within a sheet materials storage area (2) of a substantially rigid enclosure (23). Accordingly, embodiments may involve enclosing a stored sheet material (1) in a substantially rigid enclosure (23).

A substantially rigid enclosure (23) in various embodiments may include a sealed substantially rigid enclosure (23) and a reloadable substantially rigid enclosure (23). The former my involve configuring the enclosure so that it may not be readily opened, while the latter may involve configuring the enclosure so that at least a portion of the enclosure may be opened, for example as to permit the reloading of sheet materials (1) stored within the enclosure. Accordingly, embodiments may involve sealing and reloading a substantially rigid enclosure (23).

Figure 9:
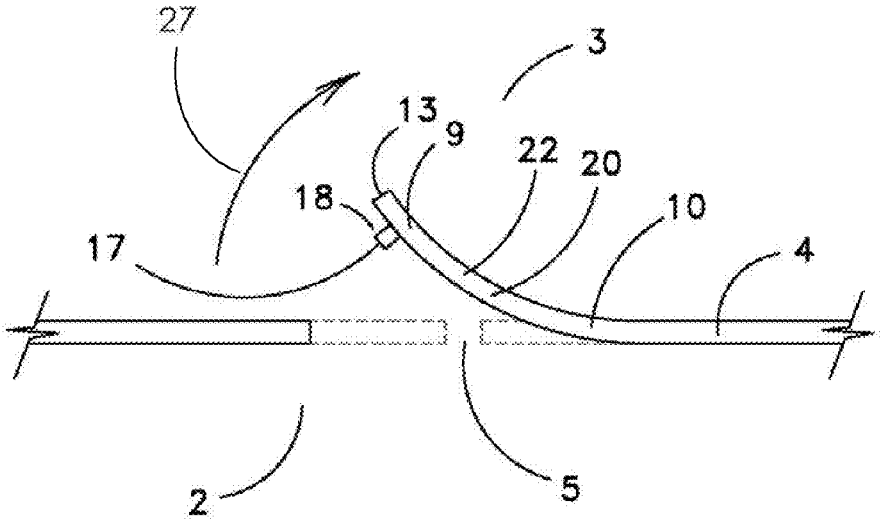
FIG. 9 is a side view of a resistance projection disposed on a yieldable intra-planar trans-axial interference tab in one embodiment.
Figure 10:
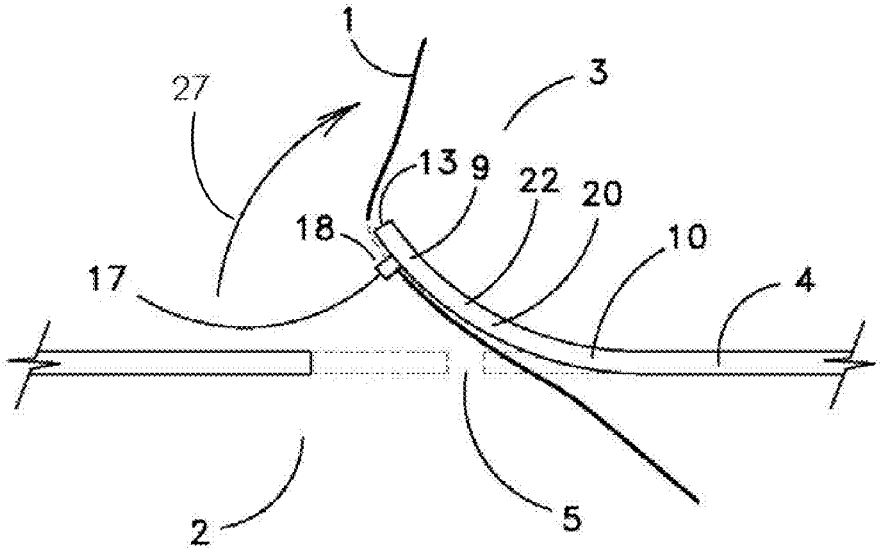
FIG. 10 is a side view of a sheet material engaged to a resistance projection disposed on a yieldable intra-planar trans-axial interference tab in one embodiment.
Figure 11:
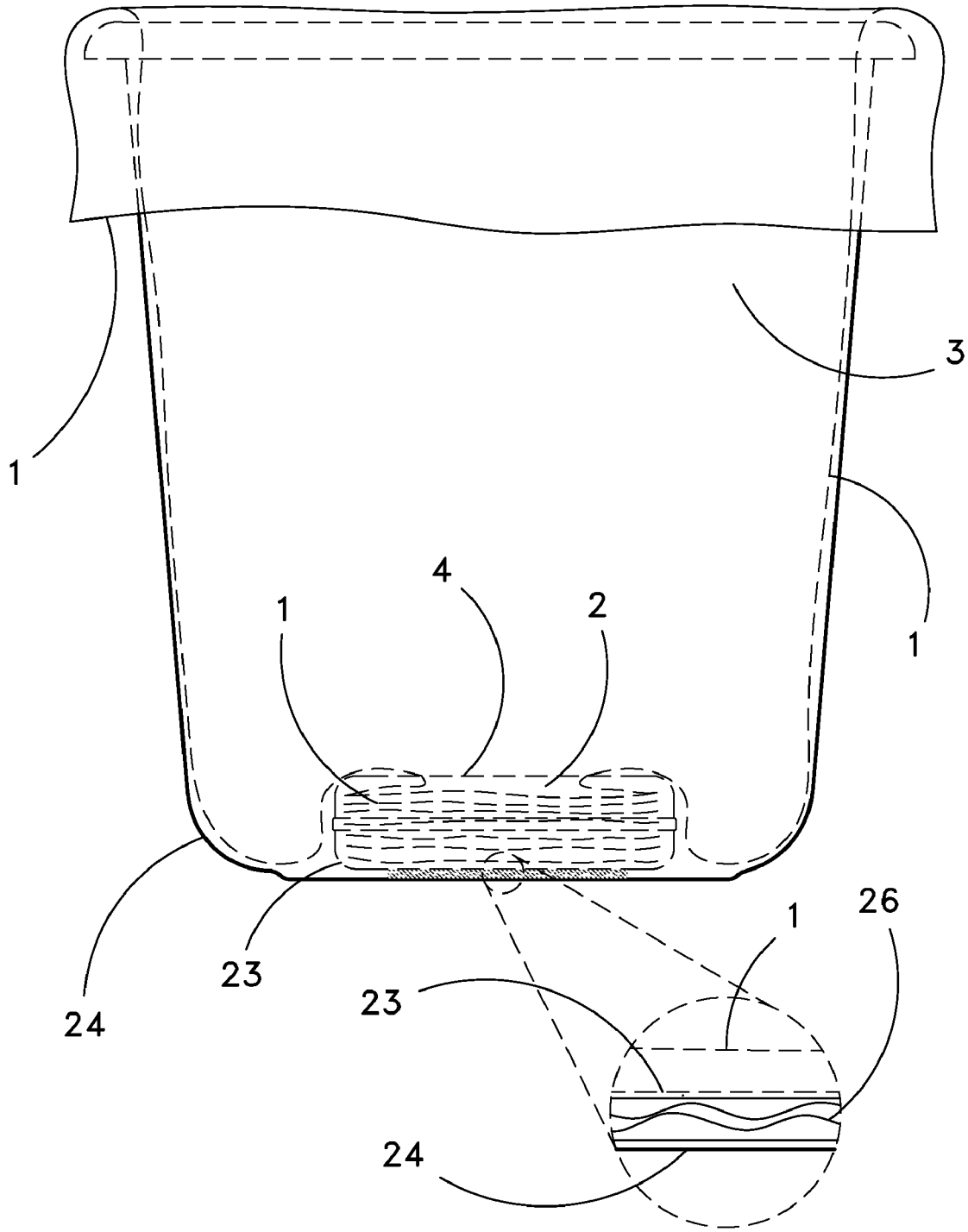
FIG. 11 is a side view of an open-ended receptacle having an expanded and placed sheet material disposed therein in one embodiment.

Now with reference primarily to FIG. 9, embodiments also may involve coordinating the dimensions of a substantially rigid enclosure (23) for placement within an open-ended receptacle (24). Such open-ended receptacles (24) may include containers having at least one portion either open or capable of being opened to receive articles for placement within the container. An example of an open-ended receptacle (24) in one embodiment may include a refuse container. However, it may be appreciated that a substantially rigid enclosure (23) may be placed within any suitable open-ended receptacle (24) consistent with the principles discussed herein. Moreover, it also may be appreciated that a dimensionally coordinated substantially rigid enclosure (23) may be configured to any form suitable to coordinate with the interior configuration of an open-ended receptacle (24). Examples may include a rectangular substantially rigid enclosure (23), an elliptical substantially rigid enclosure (23), a trapezoidal cross-sectioned substantially rigid enclosure (23), a flush-fit substantially rigid enclosure (23), a substantially rigid enclosure (23) dimensioned for placement at the bottom of a rectangular open-ended receptacle (24), a substantially rigid enclosure (23) dimensioned for placement at the bottom of a tubular open-ended receptacle (24), and the like. Of course, these examples are merely illustrative, and should not be construed to limit the configurations to which the dimensions of a substantially rigid enclosure (23) may be coordinated.

In various embodiments, the flexible sheet materials (1) discussed herein may include flexible bags. It may be appreciated that such flexible bags may be of any configuration suitable for storage in a sheet materials storage area (1) consistent with the principles discussed herein. Examples of such flexible bags may include trash bags, shopping bags, grocery bags, sandwich bags, freezer bags, and the like. However, these examples of course are merely illustrative, and should not be construed to limit the configurations to which the flexible bags described herein may take.

Such flexible bags in various embodiments may be receptacle-dimensioned expansion and placement bags. Such bags may be dimensioned to coordinate with the interior configuration of an open-ended receptacle (24) into which they may be placed. Accordingly, a receptacle-dimensioned expansion and placement bag in some embodiments may be withdrawn from a substantially rigid enclosure (23) placed within an open-ended receptacle (24), for example perhaps through a sheet materials dispensation slot (5), following which the bag may be expanded and placed within the open-ended receptacle (24), for example perhaps in the manner of a trash bag lining a refuse container. In this manner, embodiments may involve dimensioning flexible bags for expanding and placing within an open-ended receptacle (24).

With further reference to FIG. 6, moreover, various embodiments may include flexible bags having a sheet materials dispensation slot-dimensioned drawstring (25) configured to open and close a flexible bag. Such a drawstring (25) may be dimensioned to pass through the confines of a sheet materials dispensation slot (5). For example, embodiments may involve minimizing the profile of such a drawstring and its housing on a flexible bag to facilitate smooth passage of the flexible bag through a sheet materials dispensation slot (5). In various embodiments, such a drawstring (25) may include an elastic drawstring (25) disposed around the open end of a flexible bag, for example perhaps as to permit the plastic bag to grip the open end of an open-ended receptacle (24). Accordingly, embodiments may involve establishing a slot-dimensioned drawstring (25) for opening and closing flexible bags, including perhaps an elastic drawstring (25).

Embodiments also may include coding one or more sheet materials (1). For example, where multiple sheet materials (1) may be serially joined, each individual sheet material in the sequence may be coded to provide information about its position in the sequence. In some embodiments, for example, such coding on a flexible bag withdrawn from a substantially rigid enclosure (23) may inform a user how many flexible bags remain in the sequence within the substantially rigid enclosure (23). Examples of such coding may include color coding, tactile coding, alphanumeric coding, transparency coding, serial coding, and other types of coding characterized by at least one distinguishing characteristic. Of course, these examples are merely illustrative and should not be construed to limit the types of coding which may applied to sheet materials (1) consistent with the principles discussed herein.

With further reference primarily to FIG. 9, a securement element (26) in various embodiments may be joined to a substantially rigid enclosure (23). Such a securement element (26) may permit the substantially rigid enclosure (23) to be secured to a surface. For example, various embodiments may include securing a substantially rigid enclosure (23) to the interior surface of an open-ended receptacle (24), perhaps such as the bottom of a refuse container. Examples of securement elements (26) may include mechanical fasteners, adhesive fasteners, magnetic fasteners, Velcro, screws and the like. However, the examples are merely illustrative and should not be construed to limit the number or kinds of securement elements (26) that may be joined to a substantially rigid enclosure (23) consistent with the principles discussed herein.

Now with reference to FIGS. 1-9 and the foregoing discussion, in operation embodiments may include a sheet materials dispensation apparatus and a method for dispensing sheet materials. Serially joined sheet materials (1) may be stored at a sheet materials storage area (2) consistent with the principles described herein, perhaps including within a substantially rigid enclosure (23). Such serially joined sheet materials may be dispensed from the substantially rigid enclosure (23) consistent with the principles described herein, such as perhaps through a sheet materials dispensation slot (5). Such dispensation may include separating serially joined sheet materials (1) from one another consistent with the principles described herein, for example perhaps at a sheet materials separation zone (19) utilizing an interference tab (9) employing one or more of the configurations described herein. Moreover, consistent with the principles described herein, embodiments may include placing the substantially rigid enclosure (23) within an open ended receptacle (24), perhaps such as a refuse container, and the serially joined sheet materials (1) may be flexible bags. In this manner, the methods and apparatus perhaps may permit the efficient storage of flexible bags within a refuse container at their point of use, and perhaps may permit continuous point-of-use dispensation of flexible bags within the refuse container for convenient on-site placement and utilization. Of course, the foregoing is merely illustrative of some possible applications for the sheet materials dispensation apparatus and methods for dispensing sheet materials, and it will be appreciated that such apparatus and methods may be employed for any suitable application consistent with the principles described herein.

As may be easily understood from the foregoing, the basic concepts of the present inventive technology may be embodied in a variety of ways. It involves both materials dispensing techniques as well as devices to accomplish the appropriate materials dispensation. In this application, the materials dispensing techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this patent application is intended to serve as a basic description. The reader should be aware that the specific discussion may not explicitly describe all embodiments possible; many alternatives are implicit. It also may not fully explain the generic nature of the inventive technology and may not explicitly show how each feature or element can actually be representative of a broader function or of a great variety of alternative or equivalent elements. Again, these are implicitly included in this disclosure. Where the inventive technology is described in device-oriented terminology, each element of the device implicitly performs a function. Apparatus claims may not only be included for the device described, but also method or process claims may be included to address the functions the inventive technology and each element performs. Neither the description nor the terminology is intended to limit the scope of the claims that will be included in any subsequent patent application.

It should also be understood that a variety of changes may be made without departing from the essence of the inventive technology. Such changes are also implicitly included in the description. They still fall within the scope of this inventive technology. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the inventive technology both independently and as an overall system.

Further, each of the various elements of the inventive technology and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the inventive technology, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this inventive technology is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of an "enclosure" should be understood to encompass disclosure of the act of "enclosing"—whether explicitly discussed or not—and, conversely, were there effectively disclosure of the act of "enclosing", such a disclosure should be understood to encompass disclosure of an "enclosure" and even a "means for enclosing" Such changes and alternative terms are to be understood to be explicitly included in the description.

Any patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the list of References To Be Incorporated By Reference In Accordance With The Provisional Patent Application or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the materials dispensing devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) the various combinations and permutations of each of the elements disclosed, xii) each potentially dependent claim or concept as a dependency on each and every one of the independent claims or concepts presented, and xiii) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. Support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Finally, any claims set forth at any time are hereby incorporated by reference as part of this description of the inventive technology, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The invention claimed is:

1. A sheet materials dispensation apparatus comprising:

a sheet materials storage area;

a sheet materials utilization area;

a substantially rigid planar sheet materials containment surface separating said sheet materials storage area and said sheet materials utilization area;

a sheet materials dispensation slot disposed through said substantially rigid planar sheet materials containment surface having a lengthwise axis and established in communication with said sheet materials storage area and said sheet materials utilization area;

a terminal portion recess disposed along a first edge of said sheet materials dispensation slot and displaced from said lengthwise axis of said sheet materials dispensation slot;

a yieldable intra-planar trans-axial interference tab having a base portion and a terminal portion and joined to said substantially rigid planar sheet materials containment surface at said base portion and extended across said lengthwise axis of said sheet materials dispensation slot and terminating at said terminal portion within said terminal portion recess;

and further comprising a base portion recess disposed along a second edge of said sheet materials dispensation slot and wherein said yieldable intra-planar trans-axial interference tab is joined to said substantially rigid planar sheet materials containment surface within said base portion recess.

2. A sheet materials dispensation apparatus as described in claim 1, wherein said sheet materials dispensation slot comprises a unidirectional slot.

3. A sheet materials dispensation apparatus as described in claim 1, wherein said sheet materials dispensation slot comprises a straight slot and wherein said lengthwise axis comprises a straight axis.

4. A sheet materials dispensation apparatus as described in claim 1 wherein said sheet materials dispensation slot comprises a curved slot and wherein said lengthwise axis comprises a curved axis.

5. A sheet materials dispensation apparatus as described in claim 1, wherein said sheet materials dispensation slot comprises a sheet orientation confinement slot.

6. A sheet materials dispensation apparatus as described in claim 1, wherein said terminal portion recess comprises a terminal portion recess selected from the group consisting of a curved terminal portion recess, a polygonal terminal portion recess, and a pointed terminal portion recess.

7. A sheet materials dispensation apparatus as described in claim 1, wherein said terminal portion recess comprises a matched terminal portion recess.

8. A sheet materials dispensation apparatus as described in claim 1, wherein said terminal portion recess comprises a sheet material deformation confinement recess.

9. A sheet materials dispensation apparatus as described in claim 1, wherein said yieldable intra-planar trans-axial interference tab comprises a cutout.

10. A sheet materials dispensation apparatus as described in claim 1, wherein said sheet materials dispensation slot comprises a cutout.

11. A sheet materials dispensation apparatus as described in claim 1, wherein said yieldable intra-planar trans-axial interference tab comprises a trans-axial tab selected from the group consisting of a trans-axial tab centered relative to said lengthwise axis, a trans-axial tab shifted off-center relative to said lengthwise axis, a trans-axial tab perpendicular to said lengthwise axis, and a trans-axial tab intersecting said lengthwise axis.

12. A sheet materials dispensation apparatus as described in claim 1, wherein said yieldable intra-planar trans-axial interference tab comprises a sheet materials override tab.

13. A sheet materials dispensation apparatus as described in claim 1, wherein said yieldable intra-planar trans-axial interference tab comprises a sheet materials axial displacement tab.

14. A sheet materials dispensation apparatus as described in claim 1, wherein said terminal portion comprises a terminal portion selected from the group consisting of a curved terminal portion, a polygonal terminal portion, and a pointed terminal portion.

15. A sheet materials dispensation apparatus as described in claim 1, wherein said base portion recess comprises a sheet materials wraparound zone.

16. A sheet materials dispensation apparatus as described in claim 15, wherein said wraparound zone comprises a cutaway on each side of said base portion of said yieldable intra-planar trans-axial interference tab.

17. A sheet materials dispensation apparatus as described in claim 1, further comprising a sheet materials resistance projection disposed on said yieldable intra-planar trans-axial interference tab configured to resist a movement of said sheet materials drawn through said sheet materials dispensation slot.

18. A sheet materials dispensation apparatus as described in claim 1, wherein said containment surface comprises a constituent part of a substantially rigid enclosure disposed about said sheet materials storage area.

19. A sheet materials dispensation apparatus as described in claim 18, wherein said substantially rigid enclosure comprises a substantially rigid enclosure selected from the group consisting of a sealed substantially rigid enclosure and a reloadable substantially rigid enclosure.

20. A sheet materials dispensation apparatus as described in claim 18, wherein said substantially rigid enclosure comprises a dimensionally coordinated substantially rigid enclosure for placement within an open-ended receptacle.

21. A sheet materials dispensation apparatus as described in claim 20, wherein said dimensionally coordinated substantially rigid enclosure comprises a dimensionally coordinated substantially rigid enclosure selected from the group consisting of a rectangular substantially rigid enclosure, an elliptical substantially rigid enclosure, a trapezoidal cross-sectioned substantially rigid enclosure, a flush-fit substantially rigid enclosure, a dimensionally coordinated substantially rigid enclosure for placement at the bottom of a rectangular open-ended receptacle, a dimensionally coordinated substantially rigid enclosure for placement at the bottom of a tubular open-ended receptacle.

22. A sheet materials dispensation apparatus as described in claim 20, wherein said open-ended receptacle comprises a refuse container.

23. A sheet materials dispensation apparatus as described in claim 18, further comprising multiple sheet materials serially joined by sheet material separation zones stored within said sheet materials storage area.

24. A sheet materials dispensation apparatus as described in claim 23, wherein said sheet materials comprise sheet materials selected from the group consisting of rolled sheet materials, folded sheet materials, and stacked sheet materials.

25. A sheet materials dispensation apparatus as described in claim 23, wherein said sheet material separation zones comprise sheet material separation zones selected from the group consisting of perforations, at least one gap, and at least one in-line gap centered within a line of perforations.

26. A sheet materials dispensation apparatus as described in claim 23, wherein said sheet materials comprise flexible bags.

27. A sheet materials dispensation apparatus as described in claim 26, wherein said flexible bags comprise receptacle-dimensioned expansion and placement bags.

28. A sheet materials dispensation apparatus as described in claim 26, wherein each said flexible bag further comprises a sheet materials dispensation slot-dimensioned drawstring configured to open and close said flexible bag.

29. A sheet materials dispensation apparatus as described in claim 28, wherein said drawstring further comprises an elastic drawstring.

30. A sheet materials dispensation apparatus as described in claim 23, wherein said multiple sheet materials comprise coded sheet materials selected from the group consisting of color coded, tactile coded, alphanumerically coded, transparency coded, serially coded, and coded by at least one distinguishing characteristic.

31. A sheet materials dispensation apparatus as described in claim 23, further comprising a securement element joined to said substantially rigid enclosure.

32. A sheet materials dispensation apparatus as described in claim 31, wherein said securement element comprises a securement element selected from the group consisting of a mechanical fastener, an adhesive fastener, a magnetic fastener, Velcro, and a screw.

33. A sheet materials dispensation apparatus as described in claim 1, wherein said yieldable interference tab comprises a yieldable interference tab having a narrow sub-terminal dimension.

34. A sheet materials dispensation apparatus as described in claim 33, wherein said narrow sub-terminal dimension comprises a shaft portion of said yieldable interference tab having a width dimension narrower than a width dimension of said terminal portion.

35. A sheet materials dispensation apparatus as described in claim 33, wherein said narrow sub-terminal dimension comprises a width dimension of said base portion narrower than a width portion of said terminal portion.

36. A sheet materials dispensation apparatus as described in claim 33, wherein said narrow sub-terminal dimension comprises a narrow sub-terminal dimension defined by a cutaway established around each side of said base portion.

37. A sheet materials dispensation apparatus as described in claim 33, wherein said narrow sub-terminal dimension comprises a narrow sub-terminal dimension located on the opposite side of said lengthwise axis relative to said terminal portion.

38. A sheet materials dispensation apparatus as described in claim 33, wherein said narrow sub-terminal dimension comprises a yield zone of said yieldable intra-planar trans-axial interference tab.

39. A sheet materials dispensation apparatus as described in claim 1, further comprising a yield profile of said yieldable interference tab selected from the group consisting of a substantially curved yield profile, a substantially pivoted yield profile, and a yield profile having an angular displacement from 0 degrees to 90 degrees.

40. A sheet materials dispensation apparatus as described in claim 1, wherein said yieldable interference tab comprises a yieldable interference tab selected from the group consisting of a sheet material movement responsive yieldable interference tab and a sheet material movement facilitative yieldable interference tab.

41. A sheet materials dispensation apparatus as described in claim 1, wherein said yieldable interference tab comprises an increased resistance yieldable interference tab.

42. A sheet materials dispensation apparatus as described in claim 1, wherein said yieldable interference tab comprises a sheet materials resistance projection repositioned yieldable interference tab.

* * * * *